US005853101A

United States Patent [19]

Weinstein

[11] Patent Number: 5,853,101

[45] Date of Patent: Dec. 29, 1998

[54] BLISTER PACK OPENER

[75] Inventor: Jack Weinstein, Lakehurst, N.J.

[73] Assignee: Primary Delivery Systems, Inc., Easton, Pa.

[21] Appl. No.: 47,994

[22] Filed: Apr. 19, 1993

Related U.S. Application Data

[63] Continuation-in-part of Ser. No. 6,528, Jan. 21, 1993, Pat. No. 5,356,010.

[51] Int. Cl.[6] ..... B65D 17/52

[52] U.S. Cl. ..... 220/284; 225/103; 30/124; 206/532

[58] Field of Search ..... 220/284; 225/103, 225/93; 30/124; 206/532, 528, 531, 535, 539; 229/229, 103

[56] References Cited

U.S. PATENT DOCUMENTS

| | | | |
|---|---|---|---|
| 3,001,284 | 9/1961 | Marotz | 30/124 X |
| 3,175,746 | 3/1965 | Porter et al. | 30/124 X |
| 3,517,871 | 6/1970 | Gaffney et al. | 225/103 |
| 4,159,568 | 7/1979 | Berner | 30/124 |
| 4,173,826 | 11/1979 | Leopoldi et al. | 30/124 |
| 4,179,806 | 12/1979 | Lieptz | 225/103 X |
| 4,384,649 | 5/1983 | Brodsky . | |
| 4,697,344 | 10/1987 | Leopoldi | 225/103 X |
| 4,778,054 | 10/1988 | Newell et al. . | |
| 4,887,755 | 12/1989 | Gibilisco | 225/103 |
| 5,019,125 | 5/1991 | Rebne et al. . | |
| 5,038,475 | 8/1991 | Wolff | 225/103 X |
| 5,109,984 | 5/1992 | Romick . | |
| 5,118,021 | 6/1992 | Fiocchi | 225/103 |

*Primary Examiner*—Ted Kavanaugh
*Attorney, Agent, or Firm*—Kenneth P. Glynn, Esq.

[57] ABSTRACT

The present invention is directed to a blister pack opener which includes a structure designed to receive a soft pack of individually segregated unit dosages of medication. The opener or soft pack puncturing mechanism has a base segment and a top segment hingedly connected to one another. The base segment has an orifice located thereon which is of sufficient size to receive a unit dosage section of a soft pack commonly referred to as a "blister" and the top segment has a protrusion adapted to nest within the orifice of the bottom segment. The protrusion of the top segment has sufficient height so as to puncture a dosage unit section of a soft pack of medication. When a dosage unit or "blister" is placed within the orifice of the bottom segment and the top segment is hingedly pushed downwardly, the protrusion on the top segment will puncture the foil or flat element of the blister pack. Preferably, the puncture mechanism has toothed edges on this protrusion to enhance puncturing. Also, in preferred embodiments, the opener has grasping protrusions which help to hold the blister pack in place during puncturing.

10 Claims, 1 Drawing Sheet

BLISTER PACK OPENER

REFERENCE TO RELATED APPLICATION

This application is a continuation-in-part of U.S. patent application Ser. No. 08/006,528, filed on Jan. 21, 1993 now U.S. Pat. No. 5,356,010 by the same inventor herein, entitled "Container With Blister Pack Opener".

BACKGROUND OF THE INVENTION

1. Field of the Invention

The present invention is directed to soft-pack medication accessing, and more particularly, is directed to an opening which enables a user to at least partially open a soft pack of medication. By soft pack is meant a plastic and/or foil or other "push the pill or capsule out" type of medication inner package commonly known as "blister packs". Thus, the present invention is directed to an opener for soft packs of medication with individual dosage opening capabilities.

2. Information Disclosure Statement

Various inner packaging of medications have evolved over the past couple of decades which involves individual dosages arranged so as to be separated from one another within a blister pack, a paperpack, a metal/foil pack or a pack which uses a combination of materials. These may enclose powder, pills, capsules or even liquid caps or other medication dosage collections. Thus, while the application herein refers to "soft packs" or "blister packs" such terms should be read herein so as to include any type of packaging which has more than a flat shape for enclosure of individual medication dosages for easy, push out usage.

As these various forms of packaging evolved, some by mere design were difficult to open and others were intentionally made more difficult to open in order to prevent or discourage small children from easily pushing pills out of the blister packs. These packs sometimes became very difficult for the average person to open and even discouraged the purchase of over-the-counter medications packaged in this manner. Further, even those that were relatively easy for the average adult to open, were difficult for handicapped, senior citizens and people with arthritis and other hand impediments. As a result, some developments in the past decade have led to packaging with dispensing capabilities.

Thus, U.S. Pat. No. 4,384,649 issued to Louis Brodsky and assigned to E. R. Squibb and Sons, Inc. describes a dispensing package which includes a blister pack and cover with an outer shell wherein the blister pack has multiple pockets for receiving medications and the outer shell has means for sealing the cover around each pocket of the blister pack. In one embodiment the outer shell has a rim which includes studs which align with the blister pack which includes cut-outs so that when it is closed, it affords easier removal of individual medication by the user.

U.S. Pat. No. 4,778,054, issued to Robert E. Newell and Robert A. Fitzsimmons and assigned to Glaxo Group Limited, describes a package for administering medicine to patients which includes a circular carrier disk which has a puncture means for removing individual medication dosages from circular blister packs.

U.S. Pat. No. 5,019,125, issued to Thomas M. Rebne and David Esslinger and assigned to Marion Marrell Dow, Inc. describes a dispensing container which includes means for pushing individual pills or groups of pills from a blister pack within the dispensing container. The method involves removal of individual dosages from the container without removing the blister pack from the container. While this system relies upon puncturing the blister pack and pushing the pills out, there is no child resistant aspect to it as shown in the present invention. In other words, a user does not remove a blister pack and strategically place it within a puncture mechanism as in the present invention in order to remove medication from the blister pack.

U.S. Pat. No. 5,109,984 issued on May 5, 1992 to Jarome M. Romick, describes a unit dosage medication handling and dispensing system. These devices receive blister packs and hold them in place and present open bottoms so that medications may be pushed through the blister pack bottom and through the openings in the bottom of the device.

Notwithstanding the stated prior art, it is believed that the present invention is neither taught nor rendered obvious as the present invention specifically accomplishes the dual purpose of enabling a user to more easily puncture and remove medication from a blister pack while making it difficult for a child to do so by having an unattached and therefore remote puncturing mechanism which requires a blister pack to be removed from the container and properly inserted into the opener and then further requires proper usage of the opener device itself for puncture of the blister pack and subsequent removal of the medication.

SUMMARY OF THE INVENTION

The present invention is directed to a blister pack opener which includes a structure designed to receive a soft pack of individually segregated unit dosages of medication. The opener or soft pack puncturing mechanism has a base segment and a top segment which are hingedly connected to one another. The base segment has an orifice located thereon which is of sufficient size to receive a unit dosage section of a soft pack commonly referred to as a "blister" and the top segment has a protrusion adapted to nest within the orifice of the bottom segment. The protrusion of the top segment has sufficient height so as to puncture a dosage unit section of a soft pack medication. When a dosage unit or "blister" is placed within the orifice of the bottom segment and the top segment is hingedly pushed downwardly, the protrusion on the top segment will puncture the foil or flat element of the blister pack. Preferably, the puncture mechanism has toothed edges on this protrusion to enhance puncturing. Also, in preferred embodiments, the opener has grasping protrusions which help to hold the blister pack in place during puncturing.

BRIEF DESCRIPTION OF THE DRAWINGS

The present invention is more fully understood when the specification herein is taken in conjunction with the drawings appended hereto, wherein.

DETAILED DESCRIPTION OF THE INVENTION

The present invention is generally directed to individually segregated dosages of medication contained in soft packs. As mentioned in the Information Disclosure Statement above, soft packs include plasticpacks, paperpacks, metal/foil packs or packs using a combination of materials which enclose powder, pills, capsules or even liquid capsules or other medication or medicine related dosages or dosages of non-medicine related material in the form of individual units which are segregated from one another. One such soft pack is commonly referred to as a blister pack, and soft pack as used herein should be taken to mean blister packs but not solely limited to blister packs. The critical features of soft packs as used herein are that they individually segregate unit dosages of material, and that they are designed so that the user will push the unit dosage out or at least open a unit dosage containment by pushing and therefore bursting or puncturing the soft pack backing.

Thus, the present invention is directed to a container device for opening units of material contained in a soft pack of individually segregated unit dosages of material such as medication.

The opener device of the present invention, has a soft pack puncturing mechanism, as well as a base segment and a top segment. The base segment is designed with a cut-out orifice which is sized to receive at least a unit dosage portion of a soft pack. Further, the puncturing mechanism of the top segment is a protrusion which is of sufficient size to puncture a unit dosage and is properly located so as to nest within the orifice of the bottom or base segment.

Figure 1:
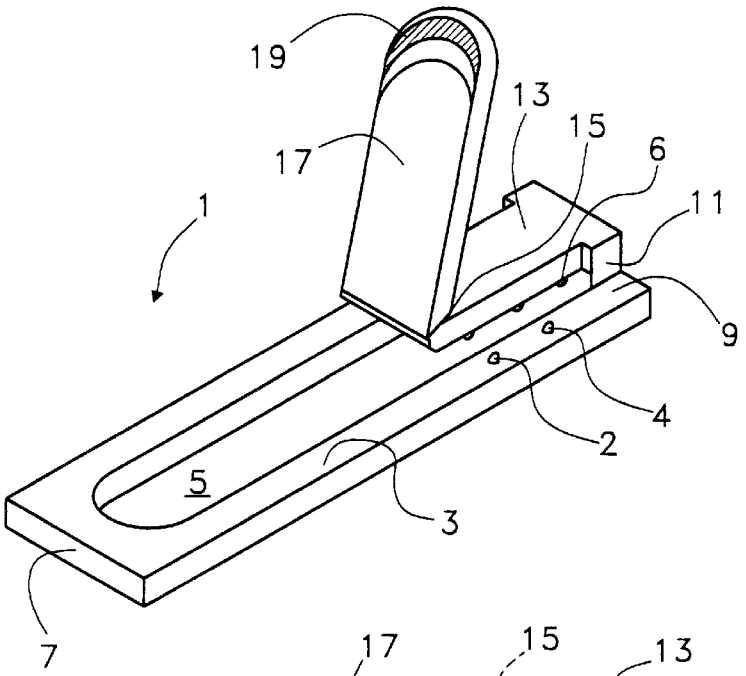
FIG. 1 shows an oblique side view of a present invention blister pack opener with a puncture mechanism.
Figure 2:
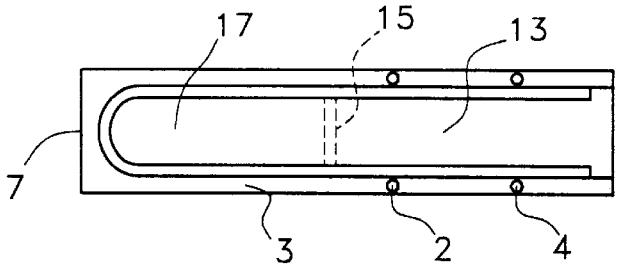
FIGS. 2 and 3 show a top and a side view of the opener shown in FIG. 1.
Figure 3:
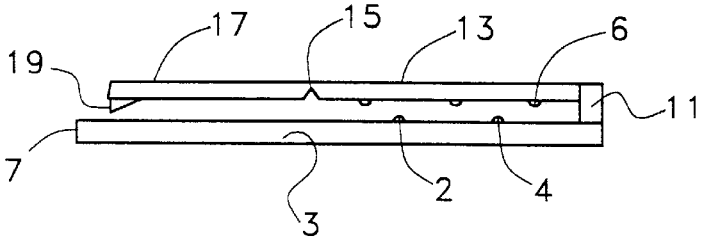

Referring now to FIGS. 1, 2 and 3 there is shown an opener 1 for blister packs which has a bottom segment 3 which is flat, and has an orifice 5 therein. Front wall 7 of bottom segment 3 is shown with upright member 11 and top segment 13. Top segment 13 includes a hinge 15 and a hingeable portion 17. Further, top segment 13, at its hingeable portion 17 has a protrusion 19 with a cutting edge, which is adapted to nest within orifice 5 when top segment portion 17 is closed. Optional holding members or protrusions 2, 4, 6 and the like are included to enhance the holding capability of opener 1.

Figure 4:
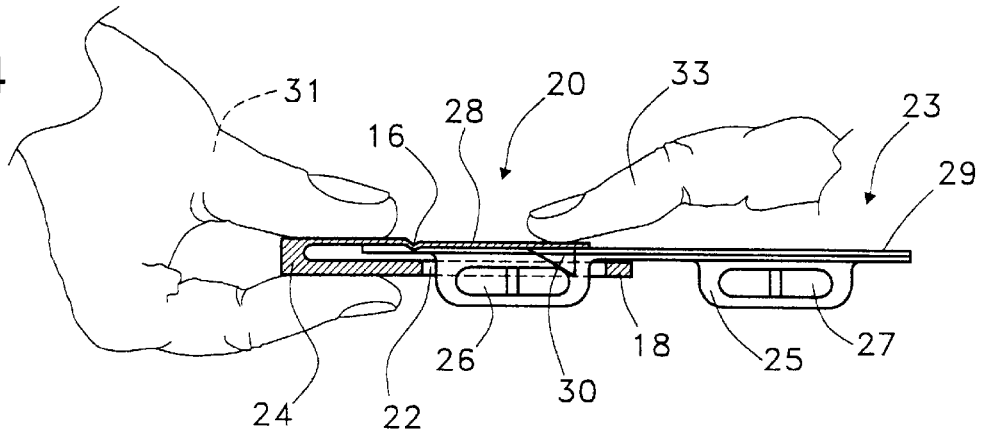
FIG. 4 shows a side cut partial view of a present invention opener in actual use, showing the puncturing of a blister pack unit dosage.

Referring to FIG. 4, there is shown a partial side view of an opener 20 as well as the side view of a soft pack 23. Soft pack 23 includes a base 29 which may be cardboard, foil or foil plastic combination and a plastic blister layer 25. Blister layer 25 has individual dosage units 26 and 27 segregated from one another and this is typical of capsule cold medicine soft packs and the like. Soft pack 23 is positioned so that individual dosage units 26 nests within orifice 22 of base segment 18 of opener 20. As shown in FIG. 4, soft pack 29 is inserted into opener 20 so that the end of soft pack 29 is moved toward opener end 24 and unit dosage 26 is dropped into orifice 22. Next, top segment 28 is pushed downwardly while being hinged at hinge 16, so that protrusion 30 with teeth punctures the back soft pack 23 where dosage unit 26 is located. FIG. 4 shows thumb 33 completely depressing top segment 28 and shows the actual puncturing of soft pack 23. Subsequently, top segment 28 is grasped and pulled upwardly so as to expose a punctured backside for dosage unit 26 to be easily removed by a user by pushing the dosage unit through the punctured backing 29.

The opener of the present invention may be formed by porous rigid foam product with an integral rigid coating, may be formed of rigid plastic materials or may be formed of plastic and paper composites. The protrusion itself may likewise be plastic or metal or some other stiff material. The particular choice of construction of materials is not critical, as long as it is designed to withstand the pressing forces needed to puncture a standard soft pack of individual dosage materials.

Further, the orifice may be elongated so as to accommodate a number of different sizes of dosage unit blisters. Also, the parent application is directed to a combined outer package and opener, whereas the present invention relates to an opener which is not formed as part of a package. However, the present invention opener could subsequently be removably attached to a package without exceeding the present scope. It could also be integrally formed with the inside soft pack or not. It may be otherwise positioned or formed and/or even inverted with the orifice facing up or in a top segment, without exceeding the scope of the present invention.

Obviously, numerous modifications and variations of the present invention are possible in light of the above teachings. It is, therefore, understood that within the scope of appended claims, the invention may be practiced otherwise than as specifically described herein.

What is claimed is:

1. A soft pack opener, which comprises:

a puncturing mechanism, a base segment and a top segment, at least a portion of said top segment and said base segment being hingedly connected to one another, said base segment having an orifice located therein which is of a respective size to receive a corresponding dosage unit section of a soft pack and said top segment having said puncture mechanism located thereon, said puncture mechanism having a puncture mechanism protrusion being of a predetermined size and shape selected so as to nest within said orifice of said bottom segment, the puncture mechanism protrusion having a predetermined height, the predetermined height relating to the dimensions of the soft pack backing and a dosage unit, the predetermined height selected so as to puncture the soft pack backing and so as to retain space between the puncture mechanism protrusion and the dosage unit when said dosage unit section is placed within said orifice of said bottom segment while said top segment is hingedly pushed downwardly.

2. The opener of claim 1 wherein the puncturing mechanism protrusion has a predetermined strength, the predetermined strength greater than the strength of the soft pack backing, the predetermined strength selected to puncture the soft pack backing of the soft pack.

3. The opener of claim 1 wherein the puncturing mechanism protrusion is a thin arcuated protrusion.

4. The opener of claim 3 wherein said base segment and orifice have individual lengths so that various sizes of said dosage unit sections of a soft pack may be inserted into said orifice.

5. The opener of claim 3 wherein the puncturing mechanism protrusion has a cutting edge.

6. The opener of claim 1 wherein said puncturing mechanism protrusion is a thin arcuated member having at least one tooth to enhance the puncturing of the soft pack backing of a dosage unit section of a soft pack.

7. The opener of claim 1 wherein said bottom segment and said top segment include protrusions for enhanced grasping of a blister pack when said opener is in use.

8. The opener of claim 1 wherein the top segment has a hingeable portion, the hingeable portion being movable, the hingeable portion having a hinged end and an opposite end, said puncturing mechanism protrusion being located near the opposite end of the hingeable portion.

9. The opener of claim 8 wherein said puncturing mechanism protrusion is a thin arcuated member having at least one tooth to enhance the puncturing of a dosage unit section of a soft pack.

10. The opener of claim 1 wherein said base segment and said orifice have individual lengths relating to the various sizes of dosage units and soft packs that may be inserted into said orifice.

* * * * *